US007019288B2

(12) United States Patent
Becker

(10) Patent No.: US 7,019,288 B2
(45) Date of Patent: Mar. 28, 2006

(54) METHODS OF MAKING SUBSTRATES FOR MASS SPECTROMETRY ANALYSIS AND RELATED DEVICES

(75) Inventor: Thomas Becker, San Diego, CA (US)

(73) Assignee: Sequenom, Inc., San Diego, CA (US)

( * ) Notice: Subject to any disclaimer, the term of this patent is extended or adjusted under 35 U.S.C. 154(b) by 0 days.

(21) Appl. No.: 10/953,855

(22) Filed: Sep. 29, 2004

(65) Prior Publication Data

US 2005/0072917 A1 Apr. 7, 2005

Related U.S. Application Data

(60) Provisional application No. 60/507,564, filed on Sep. 30, 2003.

(51) Int. Cl.
*H01J 49/26* (2006.01)

(52) U.S. Cl. ..... 250/288; 250/281; 250/282; 428/522; 428/500

(58) Field of Classification Search ..... 250/288, 250/281, 282; 428/522, 500
See application file for complete search history.

(56) References Cited

U.S. PATENT DOCUMENTS 5,233,006 A 8/1993 Wolter et al.
5,380,489 A 1/1995 Sutton et al.
5,399,738 A 3/1995 Wolter et al.
5,470,388 A 11/1995 Goedicke et al.
5,532,398 A 7/1996 Wolter et al.
5,578,350 A 11/1996 Mai et al.
5,888,723 A 3/1999 Sutton et al.
5,917,075 A 6/1999 Wolter
6,024,925 A 2/2000 Little et al.
6,197,386 B1 3/2001 Beyer et al.
6,242,054 B1 6/2001 Baalmann et al.
6,338,778 B1 1/2002 Giersch et al.
6,352,758 B1 3/2002 Huang et al.
6,569,385 B1 5/2003 Little et al.
2003/0124371 A1 * 7/2003 Um et al. ..... 428/522

* cited by examiner

*Primary Examiner*—Nikita Wells
*Assistant Examiner*—Zia R. Hashmi
(74) *Attorney, Agent, or Firm*—Bruce D. Grant; Bio Technology Law Group

(57) ABSTRACT

Substrates, methods for making the substrates and methods for using the substrates for mass spectrometry analysis are provided. Methods include coating a conductive substrate having a hydrophilic surface (suitable for mass spectrometric analysis) with an uncharged hydrophobic surface, masking a subset of regions on the hydrophobic surface with an insulator, and applying an oxidizing force to the unmasked regions of the hydrophobic surface to render the unmasked regions hydrophilic.

20 Claims, No Drawings

METHODS OF MAKING SUBSTRATES FOR MASS SPECTROMETRY ANALYSIS AND RELATED DEVICES

RELATED APPLICATIONS

This application claims the benefit of U.S. patent application No. 60/507,564 under 35 U.S.C. § 119(e), which was filed on Sep. 30, 2003, was entitled "METHODS OF MAKING SUBSTRATES FOR MASS SPECTROMETRY ANALYSIS AND RELATED DEVICES," and named Thomas Becker as an inventor. The entirety of this document is incorporated by reference.

FIELD OF THE INVENTION

Substrates for analysis of molecules and methods of making and using them are provided herein. The substrates can be used for mass spectrometry analysis.

BACKGROUND

Genetic sequencing efforts, such as the Human Genome project, have produced vast amounts of information for basic genetic research that have proven useful in developing advances in health care and drug research. These advances are possible because of improvements in engineering and instrumentation that provide advanced tools for the biotechnology community to continue with basic genetic research. With these advances, scientists can move from basic genomic discoveries to associating specific phenotypes and diseases, and can thereby better identify targets for drug development.

Nucleic acid sequencing and diagnostic methods often analyze samples deposited onto target locations on substrate arrays, including arrays and microarrays, such as microplates, silicon chips and other such supports that retain molecules, such as biological molecules, or biological particles or samples at discrete loci. Microarrays have been used to execute tests on large batches of genetic samples to generate phenotype associations and improve interpretation of the large data sets that result from such tests. A typical microarray, often referred to as a chip, includes a substrate, such as a silicon or silicon-coated substrate, on which a large number of reactive points receive samples for testing. Microarray chips provide a technology that permits operators to increase sample throughput, allowing the screening of large numbers of samples and reducing reagent costs by using submicroliter sample volumes. Preparation of such arrays employs a variety of methodologies, including printed arrays and spotted arrays, with a wide variety of substrate surfaces and different modes of quantification. The resulting microarrays are used as substrates for a variety of biochemical applications.

Some mass spectrometry formats, such as MALDI-TOF formats (e.g., axial MALDI-TOF), combine the sample to be tested with a matrix material, such as an organic acid, onto a substrate. When dried, the material forms a crystal structure. During MALDI-TOF mass spectrometry molecules are ionized from different spots of the crystal surface and travel to a particle detector, where the time-of-flight traveled indicates the mass of the particle. With some substrates, when the biomolecular sample and the porous matrix material required for mass spectrometry are loaded onto the substrate, the upper surface of the resulting crystal structures that form have been found to be rounded and to vary significantly in height (z-axis) within the same target sample loci. Because the height of the sample-matrix crystal structure can vary significantly in the z-direction, the distances traveled to the particle detector of ionized particles also can vary significantly within the same sample. A higher degree of variability for the travel distance of the same size particles from the same target loci on a substrate, results in a lower level of resolution for the mass spectra obtained by MALDI-TOF mass spectrometry analysis. Higher levels of mass spectra resolution are useful in combination with high throughput capability of the MALDI-TOF methods.

SUMMARY

There is a need for substrates that accurately receive and focus a precise amount of deposited liquid sample on target locations of the substrate in a manner that increases resolution of the mass spectra obtained. Thus, provided herein are methods of making a support suitable for mass spectrometric analysis which comprise masking a subset of regions on the surface of a support comprising a hydrophobic layer, and applying an oxidizing force to the unmasked regions of the hydrophobic surface to render the unmasked regions hydrophilic. The method, including application of the oxidizing force, results in a substrate where the hydrophilic regions have a contact angle less than or equal to 14 degrees against water. In some embodiments, the substrate comprises a hydrophilic sublayer, and in certain embodiments, the method further comprises coating a substrate having a hydrophilic surface with an uncharged hydrophobic material to form the hydrophobic surface. In a number of embodiments herein, the masking step is conducted with an insulator. In particular embodiments, the hydrophilic regions are obtained by treatment with an oxidizing force that is selected from among corona discharge, plasma treatment, laser treatment, among other oxidizing forces known to those of skill in the art. In an embodiment, the oxidizing force is corona discharge treatment, and is used to selectively oxidize the unmasked regions. The use of corona discharge treatment in this manner results in hydrophilic anchors having lower contact angles than previously available. The lower contact angles achieved within the hydrophilic target regions results in greater contact angle differentials between the hydrophobic and hydrophilic regions on the surface of the substrate. This in turn results in a more uniform, even distribution, in the z-direction, of the biomolecular sample-matrix crystal structure on the hydrophilic target loci. The increased uniformity of distribution in the z-direction of the sample-matrix crystal structure results in less variability in flight time and the distance traveled by the ionized particles within the same target loci to the particle detector during MALDI-mass spectrometry analysis.

In some embodiments, the hydrophilic regions can have a contact angle less than or equal to 13, 12, 11, 10, 9, 8, 7, 6, 5, 4, 3, 2 or 1 degrees against water. The contact angle differential between the hydrophobic and hydrophilic regions can be greater than a differential selected from 55, 60, 65, 70, 75, 80, 85 or 90 degrees against water. In certain embodiments, the substrate and/or hydrophobic surface is substantially non-retroreflective. In particular embodiments, the hydrophilic regions can have a surface (wetting) energy in the range of about 60 $mJ/m^2$ up to about 73 $mJ/m^2$. In some embodiments, the hydrophilic regions can have a surface (wetting) energy in the range of about 69 $mJ/m^2$ up to about 73 $mJ/m^2$ (e.g. 69, 70, 71, 72 or 73 $mJ/m^2$). In a particular embodiment, the hydrophilic regions have a surface (wetting) energy of about 73 $mJ/m^2$. Typically, the hydrophilic regions occupy less surface area than the hydrophobic regions, and often are uniformly spaced on the substrate.

In certain embodiments when using the support for mass spectrometry analysis of DNA molecules to obtain mass spectra, the percentage of the total spectra obtained that are at a "mass deviation" of ≦0.5 Da is a percentage of the total spectra obtained selected from ≧25%, ≧30%, ≧40%, ≧50%, ≧55%, ≧60%, ≧65%, ≧70%, ≧75% of the total spectra obtained. In some embodiments, the percentage of the total spectra obtained that are at a mass deviation of ≦1.0 Da is a percentage of the total spectra obtained selected from ≧40%, ≧50%, ≧55%, ≧60%, ≧65%, ≧70%, ≧75%, ≧80%, ≧85%, ≧90%, ≧91%, ≧92%, ≧93%, ≧94%, ≧95%, ≧96%, ≧97%, ≧98%, ≧99%, ≧99.9% of the total spectra obtained.

In certain embodiments, the hydrophobic surface is devoid or substantially devoid of inorganic oxide particles. In some embodiments, the conductive substrate comprises a surface material that has an available —OH or primary amine. In a particular embodiment, the hydrophobic region is dimethyldichlorosilane (DMDCS); and the substrate is selected from the group consisting of a metal, a plastic and a silicon or silicon dioxide, which forms the hydrophilic regions.

Provided also are methods of making a support suitable for mass spectrometric analysis by coating a conductive substrate having a hydrophilic surface (suitable for mass spectrometric analysis) with an uncharged hydrophobic surface, masking a subset of regions on the hydrophobic surface with an insulator, applying an oxidizing force to the unmasked regions of the hydrophobic surface to render the unmasked regions hydrophilic. The method, including application of the oxidizing force results in a substrate where the hydrophilic regions have a contact angle less than or equal to 14 degrees against water. Also provided are methods of making a support for mass spectrometric analysis comprising coating a conductive substrate with a hydrophilic surface (suitable for mass spectrometric analysis); coating the conductive substrate having a hydrophilic surface (suitable for mass spectrometric analysis) thereon with an uncharged hydrophobic surface; masking a subset of regions on the hydrophobic surface; and applying an oxidizing force to the unmasked regions of the hydrophobic surface to render the unmasked regions hydrophilic; where the hydrophilic regions have a contact angle less than or equal to 14 degrees.

Also provided are chips and/or supports for mass spectrometry analysis produced by the methods provided herein. Thus, provided herein are supports suitable for mass spectrometric analysis. The supports include a conductive substrate and discrete hydrophobic and hydrophilic regions on the substrate surface, where the hydrophilic regions have a contact angle less than or equal to 14 degrees. In some embodiments, provided are supports for use in mass spectrometry analysis, comprising target locations defined by application of a hydrophobic film on a conductive substrate and oxidation of the target locations on the substrate; where the resulting array of target locations on the substrate are hydrophilic regions having contact angles less than 14 degrees and sometimes less than 10 degrees. In some embodiments, the hydrophilic regions can have a contact angle less than or equal to 13, 12, 11, 10, 9, 8, 7, 6, 5, 4, 3, 2 or 1 degrees. The contact angle differential between the hydrophobic and hydrophilic regions can be greater than an amount selected from 55, 60, 65, 70, 75, 80, 85 and 90 degrees. In certain embodiments, the substrate and/or hydrophobic surface is substantially non-retroreflective. In some embodiments hydrophilic regions have a surface (wetting) engery in the range of about 69 mJ/m$^2$ up to about 73 mJ/m$^2$ (e.g., 69, 70, 71, 72 or 73 mJ/m$^2$). In a particular embodiment, the hydrophilic regions have a surface (wetting) energy of about 73 mJ/m$^2$. Typically, the hydrophilic regions occupy less surface area than the hydrophobic regions, and often are uniformly spaced on the substrate.

In particular embodiments, the hydrophilic regions are obtained by treatment with an oxidizing force, which can be selected from corona discharge, plasma treatment, laser treatment, among other oxidizing forces know to those of skill in the art. In certain embodiments, the hydrophobic surface is devoid of inorganic oxide particles. In some embodiments, the conductive substrate comprises a surface material that has an available —OH or primary amine. In a particular embodiment, the hydrophobic region is dimethyldichlorosilane (DMDCS); and the substrate is selected from the group consisting of a metal, a plastic and a silicon or silicon dioxide, which forms the hydrophilic regions. The resulting contact angle often depends upon the dose of the oxidizing force applied to the substrate, and in some embodiments, the contact angle is controlled or predetermined according to the dose of the oxidizing force applied to the substrate. Parameters defining a dose of an oxidizing force applied to a substrate, such as a corona discharge dose for example, are known and described herein.

In certain embodiments when using the support for mass spectrometry analysis of DNA molecules to obtain mass spectra, the percentage of the total spectra obtained that are at a mass deviation of ≦0.5 Da is a percentage of the total spectra obtained selected from ≧25%, ≧30%, ≧40%, ≧50%, ≧55%, ≧60%, ≧65%, ≧70%, ≧75% of the total spectra obtained. In some embodiments, the percentage of the total spectra obtained that are at a mass deviation of ≦1.0 Da is a percentage of the total spectra obtained selected from ≧40%, ≧50%, ≧55%, ≧60%, ≧65%, ≧70%, ≧75%, ≧80%, ≧85%, ≧90%, 91%, ≧92%, ≧93%, ≧94%, ≧95%, ≧96%, ≧97%, ≧98%, ≧99%, ≧99.9% of the total spectra obtained.

Also provided are methods for mass spectrometric analysis comprising coating a conductive substrate having a hydrophilic surface (suitable for mass spectrometric analysis) with an uncharged hydrophobic surface; masking a subset of regions on the hydrophobic surface; applying an oxidizing force to the unmasked regions of the hydrophobic surface to render the unmasked regions hydrophilic; applying a matrix material and sample to the hydrophilic regions on the substrate; introducing the substrate into a mass spectrometer for analysis of the samples; and analyzing the samples by mass spectrometry. In some embodiments, provided are methods for mass spectrometric analysis comprising coating a conductive substrate with a hydrophilic surface (suitable for mass spectrometric analysis); coating the conductive substrate having a hydrophilic surface (suitable for mass spectrometric analysis) thereon with an uncharged hydrophobic surface; masking a subset of regions on the hydrophobic surface; applying an oxidizing force to the unmasked regions of the hydrophobic surface to render the unmasked regions hydrophilic; applying a matrix material and sample to the hydrophilic regions on the substrate; introducing the substrate into a mass spectrometer for analysis of the samples; and analyzing the samples by mass spectrometry.

Also provided herein are methods for mass spectrometric analysis comprising applying matrix material and sample to the hydrophilic regions on the supports provided herein; introducing the substrate into a mass spectrometer for analysis of the samples; and analyzing the samples by mass spectrometry.

Other features and advantages of the compositions and methods provided herein should be apparent from the following description of preferred embodiments, which illustrate, by way of example, the principles of the methods and compositions and substrates.

DETAILED DESCRIPTION

Definitions

A. Substrates/supports

B. Hydrophilic Layers

C. Hydrophobic Layers

D. Masks

E. Treatments

F. Sample Preparation

Definitions

As used herein, the term "support" or "solid support" refers to a non-gaseous, non-liquid material having a surface. Thus, a solid support can be a flat surface constructed, for example, of glass, silicon, metal, plastic or a composite; or can be in the form of a bead such as a silica gel, a controlled pore glass, a magnetic or cellulose bead; or can be a pin, including an array of pins suitable for combinatorial synthesis or analysis.

As used herein, the phrase "mass spectrometric analysis" or grammatical variations thereof, encompasses any suitable mass spectrometric format known to those of skill in the art. Such formats include, but are not limited to, Matrix-Assisted Laser Desorption/Ionization, Time-of-Flight (MALDI-TOF), IR-MALDI (see, e.g., published International PCT Application No. WO 99/57318 and U.S. Pat. No. 5,118,937) Ion Cyclotron Resonance (ICR), Fourier Transform and combinations thereof. MALDI, particular UV and IR, are among exemplary formats.

As used herein, "substrate" refers to an insoluble support onto which a sample and/or matrix is deposited. Supports can be fabricated from virtually any insoluble or solid material. For example, the support can be fabricated from silica gel, glass (e.g., controlled-pore glass (CPG)), nylon, Wang resin, Merrifield resin, Sephadex, Sepharose, cellulose, magnetic beads, Dynabeads, a metal surface (e.g., steel, gold, silver, aluminum, silicon and copper); a plastic material (e.g., polyethylene, polypropylene, polyamide, polyester, polyvinylidenedifluoride (PVDF)). Exemplary substrates include, but are not limited to, beads (e.g., silica gel, controlled pore glass, magnetic, Sephadex/Sepharose, cellulose), capillaries, flat supports such as glass fiber filters, glass surfaces, metal surfaces (steel, gold, silver, aluminum, copper and silicon), plastic materials including multiwell plates or membranes (e.g., of polyethylene, polypropylene, polyamide, polyvinylidenedifluoride), pins (e.g., arrays of pins suitable for combinatorial synthesis or analysis or beads in pits of flat surfaces such as wafers (e.g., silicon wafers) with or without plates. In particular embodiments, the substrate is a conductive metal. The solid support can be made in any desired form (e.g., suitable for mounting on a cartridge base), including, but not limited to: a bead, capillary, plate, membrane, wafer, comb, pin, a wafer with pits, an array of pits or nanoliter wells and other geometries and forms known to those of skill in the art. Exemplary supports can be flat surfaces designed to receive or link samples at discrete loci, such as flat surfaces with hydrophobic regions surrounding hydrophilic loci for receiving, containing or binding a sample. Thus, a surface of the substrate sometimes is substantially planar, and sometimes is not spherical (e.g., a substrate utilized sometimes is not a bead or particle).

As used herein, the term "coating" refers generally to the act of applying a layer of material to a substrate or support. The layers of material that can be coated include hydrophilic layers or hydrophobic layers, or matrix layers. Numerous methods for coating layers of material onto substrates are well-known in the art and include but are not limited to plasma treatment, and the like. In particular embodiments provided herein, corona discharge is used to coat one or more layers of material onto a substrate.

As used herein the phrase "conductive substrate", which can be in the form of a chip, refers to an electrically conductive substrate or can be a dielectric substrate. Accordingly, the substrate can be manufactured of a semi-conductive material such as silicon or other materials known to those skilled in the art. Substrates sometimes are composed of conductive and non-conductive materials, such as a chip composed of a conductive material coated or partially coated with a thin coating composed of a non-conductive material, for example.

As used herein, the term "hydrophilic," in the context of surfaces, refers to an easily wettable surface for the type of sample liquid used, even if the sample is not an aqueous solution. Typically, the hydrophilic surfaces contain ionic charges thereon to facilitate the wettability of the surface by aqueous solutions, such as 3-Hydroxy picolinic acid (a DNA/RNA matrix). The hydrophilic surfaces are used herein on a substrate to serve as target regions or loci onto which the sample and MALDI matrix solutions are applied for subsequent mass spectrometry analysis. The level of hydrophilicity (also referred to herein as the surface energy) can be altered to achieve the desired level of wettability of the aqueous solutions deposited thereon.

As used herein, the phrase "substrate having a hydrophilic surface" refers to a substrate, e.g., a conductive substrate, that comprises a hydrophilic surface. Substrates having a hydrophilic surface can be made by coating a conductive substrate with a hydrophilic surface using well-known methods, such as vapor deposition methods described herein, or can be made of a conductive substrate that has a hydrophilic surface. For example, a $SiO_2$ hydrophilic surface layer can be made using corona discharge as described in Example 1.

As used herein, the term "hydrophobic," in the context of surfaces, refers to an uncharged, unwettable and liquid-repellant surface for the sample liquid used, even if the liquid is not an aqueous solution. In the case of an oily sample solution, it should be a lipophobic surface. Typically, the biomolecules dissolve best in water, sometimes with the addition of organic, water-soluble solvents.

As used herein, the phrase "masking a subset of regions" refers to the well-known method of covering discrete regions on a surface (such as discrete hydrophobic and hydrophilic regions) so that only the regions that are not covered are exposed to the environment. Only the regions that are exposed to the environment are affected by any treatments or processes designed to effect a change on the surface of the substrate, such as corona discharge treatment. Exemplary masking agents are well known in the art and include, among others, insulators, such as ceramic.

As used herein the phrase "discrete hydrophobic and hydrophilic regions" refers to alternating regions on the surface of a substrate, such that an array of hydrophilic regions are produced. The hydrophilic regions are uniformly spaced on the support or substrate to provide consistent region-to-region high throughput analysis.

As used herein, "array" refers to a collection of elements, member or regions, such as hydrophilic regions. Typically an array contains three or more members or regions. An addressable array is one in which the members or regions of the array are identifiable, typically by position on a solid support. Hence, in general the members or regions of the array are uniformly spaced at discrete identifiable loci on the surface of a solid phase. An addressable array is one in which the members of the array are identifiable, typically by position on a solid phase support or by virtue of an identifiable or detectable label, such as by color, fluorescence, electronic signal (i.e. RF, microwave or other frequency that does not substantially alter the interaction of the molecules or biological particles), bar code or other symbology, chemical or other such label. In some instances, those of skill in the art refer to microarrays. A microarray is a an array, typically a positionally addressable array, such as an array on a solid support, in which the loci of the array are at high density. For example, a typical array formed on a surface the size of a standard 96 well microtiter plate with 96 loci, 384, or 1536 is not a microarray. Arrays at higher densities, such as greater than 2000, 3000, 4000 and more loci per plate are considered microarrays.

As used herein the phrase "contact angle" refers to the level of wetting ability (wettability) of a particular liquid on a particular surface. The contact angle is the angle formed by the solid/liquid interface and the liquid/vapor interface measured from the side of the liquid. The contact angle of a liquid is the result of the mechanical equilibrium of a drop resting on a plane solid surface under the action of three surface tensions: 1) at the interface of the liquid and vapor phases; 2) at the interface of the solid and the liquid; and 3) at the interface of the solid and vapor.

As used herein, with respect to the supports provided herein, an element or region is defined as less hydrophobic than another by the relative "wettability" of the element or contact angles, where the contact angle of an element is less than the surrounding surface. The contact angle also is referred to as the angle that breaks the surface tension when a liquid is delivered. A hydrophilic substrate requires a relatively lower contact angle than a more hydrophobic material. Hence contact angle reflects the relative hydrophobicity between or among surfaces.

Wetting ability of a liquid is a function of the surface energies of the solid-gas interface, the liquid-gas interface, and the solid-liquid interface. The surface energy across an interface or the surface tension at the interface is a measure of the energy required to form a unit area of new surface at the interface. The intermolecular bonds or cohesive forces between the molecules of a liquid cause surface tension. When the liquid encounters another substance, there is usually an attraction between the two materials. The adhesive forces between the liquid and the second substance compete against the cohesive forces of the liquid. Liquids with weak cohesive bonds and a strong attraction to a second material (or the predisposition to create adhesive bonds) tends to spread over the second material (e.g., lower contact angles). Liquids with strong cohesive bonds and weaker adhesive attraction for a second material tends to bead-up or form a droplet when in contact with the second material (e.g., higher contact angles).

As used herein, the phrase "surface tension" of a droplet refers to the cohesive forces between liquid molecules at the surface. The molecules at the surface do not have other like molecules on all sides of them and consequently they cohere more strongly to those directly associated with them on the surface. This forms a surface "film" at the interface of the liquid and vapor phases of a droplet which is more difficult to move an object through than moving the same object through the same liquid when it is completely submersed. Surface tension is typically measured in dynes/cm, which correspond to the force in dynes required to break a film of length 1 cm. Equivalently, it can be stated as surface energy in ergs per square centimeter. For example, water at 20° C. has a surface tension of 72.8 dynes/cm compared to 22.3 dynes/cm for ethyl alcohol and 465 for mercury. Accordingly, the phrase "surface energy" refers to the force in ergs required to break a film of 1 square cm. As set forth herein, the a higher surface energy corresponds to a higher hydrophilicity, which in turn corresponds to a lower contact angle. These characteristics of a lower contact angle result in a sample crystalline surface structure that is flatter and has less arch (e.g., less ion variation in the z-direction) than samples deposited on hydrophilic surfaces having higher contact angles. These characteristics of a lower contact angle result in increased uniformity of distribution in the z-direction of the sample-matrix crystal structure, and result in less variability in the flight time and distance traveled by the ionized particles within the same target loci to the particle detector during MALDI-mass spectrometry analysis.

As used herein, the phrase "oxidizing force" refers to any treatment that can generate ionized reactive groups (e.g., hydroxl groups or primary amines) on the surface of a substrate. These ionized reactive groups in turn render the surface hydrophilic having a high level wettability with low contact angles. The oxidizing forces used herein can remove one or more hydrophobic regions, e.g., corona treatment removes —$CH_3$ groups and thereby oxidizes the substrate surface. Suitable oxidizing forces for use herein include, but are not limited to corona treatment, plasma treatment, or laser treatment. In certain embodiments, hydrophilic regions are obtained by treatment with an oxidizing force. In a particular embodiment, corona treatment is used to selectively remove hydrophobic regions from a masked substrate that has previously been coated with a hydrophilic surface layer beneath the hydrophobic layer.

As used herein, the phrase "uncharged hydrophobic surface" refers to a hydrophobic surface and/or layer that does not contain any inorganic oxide particles therein. The phrase "inorganic oxide particles" refers to particles having a reactive oxygen that can be ionized, such as silica particles that can be derived from colloidal silica dispersions, and metal oxide particles, such as aluminum oxide, titanium oxide and zirconium oxide. In an exemplary embodiment, the uncharged hydrophobic surface of a substrate is devoid of inorganic oxide particles.

As used herein, the term "retroreflective" refers to a surface that has the ability to return or reflect a substantial portion of incident light in the general direction from which the light originated. In exemplary embodiment, neither the substrate nor the hydrophobic and/or the hydrophilic regions thereon are retroreflective.

As used herein, the phrase "uniformly spaced" refers to the defined and controlled placement of the hydrophilic regions at positions on the substrate, such that the regions can be controllably and reproducibly analyzed (e.g., by rastering) in a high throughput format. For example, chips for DNA analysis require precise equal distances between the nucleic acid samples, and thus the hydrophilic regions, to enable high throughput automated measurements to be acquired, such as by MALDI-TOF mass spectrometry. For example, in a particular embodiment, the hydrophilic regions are uniformly spaced on the substrate.

As used herein, a "molecule" refers to any molecule or compound that is linked to a substrate. A molecule refers to any compound found in nature or derivatives thereof or synthetic compounds and, include but are not limited to, biopolymers, biomolecules, macromolecules or components or precursors thereof, such as peptides, proteins, organic compounds, oligonucleotides or monomeric units of the peptides, organics, nucleic acids and other macromolecules. A monomeric unit refers to one of the constituents from which the resulting compound is built. Thus, monomeric units include, nucleotides, amino acids, and pharmacophores from which small organic molecules are synthesized.

As used herein, the term "macromolecule" refers to any molecule having a molecular weight from the hundreds up to the millions. Macromolecules include, but are not limited to, peptides, proteins, nucleotides, nucleic acids, and other such molecules that are generally synthesized by biological organisms, but can be prepared synthetically or using recombinant molecular biology methods.

As used herein, the term "biopolymer" is a biological molecule, including macromolecules, composed of two or more monomeric subunits, or derivatives thereof, which are linked by a bond or a macromolecule. A biopolymer can be, for example, a polynucleotide, a polypeptide, a carbohydrate, or a lipid, or derivatives or combinations thereof, for example, a nucleic acid molecule containing a peptide nucleic acid portion or a glycoprotein, respectively. The methods and systems herein, though described with reference to biopolymers, can be adapted for use with other synthetic schemes and assays, such as organic syntheses of pharmaceuticals, or inorganics and any other reaction or assay performed on a solid support or in a well in nanoliter or smaller volumes.

As used herein, a biological particle refers to a virus, such as a viral vector or viral capsid with or without packaged nucleic acid, phage, including a phage vector or phage capsid, with or without encapsulated nucleotide acid, a single cell, including eukaryotic and prokaryotic cells or fragments thereof, a liposome or micellar agent or other packaging particle, and other such biological materials. For purposes herein, biological particles include molecules that are not typically considered macromolecules because they are not generally synthesized, but are derived from cells and viruses.

As used herein, the "nucleic acid" refers to single-stranded and/or double-stranded polynucleotides such as deoxyribonucleic acid (DNA), and ribonucleic acid (RNA) as well as analogs or derivatives of either RNA or DNA. Also included in the term "nucleic acid" are analogs of nucleic acids such as peptide nucleic acid (PNA), phosphorothioate DNA, and other such analogs and derivatives or combinations thereof.

As used herein, the term "polynucleotide" refers to an oligomer or polymer containing at least two linked nucleotides or nucleotide derivatives, including a deoxyribonucleic acid (DNA), a ribonucleic acid (RNA), and a DNA or RNA derivative containing, for example, a nucleotide analog or a "backbone" bond other than a phosphodiester bond, for example, a phosphotriester bond, a phosphoramidate bond, a phophorothioate bond, a thioester bond, or a peptide bond (peptide nucleic acid). The term "oligonucleotide" also is used herein essentially synonymously with "polynucleotide," as used herein can also be referred to as oligonucleotides, for example, PCR primers, generally are less than about fifty to one hundred nucleotides in length.

Nucleotide analogs contained in a polynucleotide can be, for example, mass modified nucleotides, which allows for mass differentiation of polynucleotides; nucleotides containing a detectable label such as a fluorescent, radioactive, luminescent or chemiluminescent label, which allows for detection of a polynucleotide; or nucleotides containing a reactive group such as biotin or a thiol group, which facilitates immobilization of a polynucleotide to a solid support. A polynucleotide also can contain one or more backbone bonds that are selectively cleavable, for example, chemically, enzymatically or photolytically. For example, a polynucleotide can include one or more deoxyribonucleotides, followed by one or more ribonucleotides, which can be followed by one or more deoxyribonucleotides, such a sequence being cleavable at the ribonucleotide sequence by base hydrolysis. A polynucleotide also can contain one or more bonds that are relatively resistant to cleavage, for example, a chimeric oligonucleotide primer, which can include nucleotides linked by peptide nucleic acid bonds and at least one nucleotide at the 3' end, which is linked by a phosphodiester bond, or the like, and is capable of being extended by a polymerase. Peptide nucleic acid sequences can be prepared using well known methods (see, for example, Weiler et al., Nucleic Acids Res. 25(14):2792–2799 (1997)).

A polynucleotide can be a portion of a larger nucleic acid molecule, for example, a portion of a gene, which can contain a polymorphic region, or a portion of an extragenic region of a chromosome, for example, a portion of a region of nucleotide repeats such as a short tandem repeat (STR) locus, a variable number of tandem repeats (VNTR) locus, a microsatellite locus or a minisatellite locus. A polynucleotide also can be single-stranded or double-stranded, including, for example, a DNA-RNA hybrid, or can be triple-stranded or four-stranded. Where the polynucleotide is double-stranded DNA, it can be in an A, B, L or Z configuration, and a single polynucleotide can contain combinations of such configurations.

As used herein, the term "polypeptide," means at least two amino acids, or amino acid derivatives, including mass modified amino acids and amino acid analogs, that are linked by a peptide bond, which can be a modified peptide bond. A polypeptide can be translated from a polynucleotide, which can include at least a portion of a coding sequence, or a portion of a nucleotide sequence that is not naturally translated due, for example, to its location in a reading frame other than a coding frame, or its location in an intron sequence, a 3' or 5' untranslated sequence, a regulatory sequence such as a promoter. A polypeptide also can be chemically synthesized and can be modified by chemical or enzymatic methods following translation or chemical synthesis. The terms "polypeptide," "peptide" and "protein" are used essentially synonymously herein, although the skilled artisan recognizes that peptides generally contain fewer than about fifty to one hundred amino acid residues, and that proteins often are obtained from a natural source and can contain, for example, post-translational modifications. A polypeptide can be post translationally modified by, for example, phosphorylation (phosphoproteins), glycosylation (glycoproteins, proteoglycans), which can be performed in a cell or in a reaction in vitro.

As used herein, the term "conjugated" refers to stable attachment, typically by virtue of a chemical interaction, including ionic and/or covalent attachment. Among preferred conjugation means are: streptavidin- or avidin- to biotin interaction; hydrophobic interaction; magnetic interaction (e.g., using functionalized magnetic beads, such as DYNABEADS, which are streptavidin-coated magnetic beads sold by Dynal, Inc. Great Neck, N.Y. and Oslo Norway); polar interactions, such as "wetting" associations between two polar surfaces or between oligo/polyethylene glycol; formation of a covalent bond, such as an amide bond, disulfide bond, thioether bond, or via crosslinking agents; and via an acid-labile or photocleavable linker.

As used herein, "sample" refers to a composition containing a material to be detected. In a preferred embodiment, the sample is a "biological sample" (i.e., any material obtained from a living source (e.g., human, animal, plant, bacteria, fungi, protist, virus). The biological sample can be in any form, including solid materials (e.g., tissue, cell pellets and biopsies) and biological fluids (e.g., urine, blood, saliva, amniotic fluid and mouth wash (containing buccal cells)). Solid materials often are mixed with a fluid. In particular, herein, the sample refers to a mixture of matrix used or mass spectrometric analyses and biological material such as nucleic acids. Pin tools and systems sometimes are used to dispense nucleic acid compositions into matrix that has been deposited on a substrate or to dispense compositions containing matrix material and biological material such as nucleic acids onto a selected locus or plurality of loci on a substrate (e.g., U.S. Pat. Nos. 6,569,385 and 6,024,925). Thus, provided herein is a substrate which comprises a sample component, such as a nucleic acid (e.g., DNA and/or RNA); a protein, polypeptide or peptide; or a combination thereof. Also provided is a substrate which comprises a matrix material. The substrate often is devoid or substantially devoid of particles. In embodiments where a substrate is in contact with a nucleic acid, the nucleic acid often is not covalently linked to the substrate.

As used herein, a composition refers to any mixture. It can be a solution, a suspension, liquid, powder, a paste, aqueous, non-aqueous or any combination thereof.

As used herein, a combination refers to any association among two or more items. The combination can be two or more separate items, such as two compositions or two collections, can be a mixture thereof, such as a single mixture of the two or more items, or any variation thereof.

As used herein, fluid refers to any composition that can flow. Fluids thus encompass compositions that are in the form of semi-solids, pastes, solutions, aqueous mixtures, gels, lotions, creams and other such compositions.

As used herein, the term "target site" refers to a specific locus on a solid support upon which material, such as matrix material, matrix material with sample, and sample, can be deposited and retained. A solid support contains one or more target sites, which can be arranged randomly or in an ordered array or other pattern. When used for mass spectrometric analyses, such as MALDI analyses, a target site or the resulting site with deposited material, can be selected to be equal to or less than the size of the laser spot that is to be focused on the substrate to effect desorption. Thus, a target site can be, for example, a well or pit, a pin or bead, or a physical barrier that is positioned on a surface of the solid support, or combinations thereof such as a beads on a chip, chips in wells, or the like. A target site can be physically placed onto the support, can be etched on a surface of the support, can be a "tower" that remains following etching around a locus, or can be defined by physico chemical parameters such as relative hydrophilicity, hydrophobicity, or any other surface chemistry that retains a liquid therein or thereon. A solid support can have a single target site, or can contain a number of target sites, which can be the same or different, and where the solid support contains more than one target site, the target sites can be arranged in any pattern, including, for example, an array, in which the location of each target site is defined. A pin tool utilized for sample and/or matrix deposition sometimes contains blocks that hold the pins in a pattern that matches the pattern of target sites on the support, such that upon contacting the support, the ends of the pins surround, but do not touch each loci nor any of the loci (e.g., U.S. Pat. Nos. 6,569,385 and 6,024,925).

As used herein, the term "predetermined volume" is used to mean any desired volume of a liquid. For example, where it is desirable to perform a reaction in a 5 microliter volume, 5 microliters is the predetermined volume. Similarly, where it is desired to deposit 200 nanoliters at a target site, 200 nanoliters is the predetermined volume.

As used herein, the term "liquid dispensing system" means a device that can transfer a predetermined amount of liquid to a target site. The amount of liquid dispensed and the rate at which the liquid dispensing system dispenses the liquid to a target site can be varied as is well-known in the art.

As used herein, the term "liquid" is used broadly to mean a non solid, non gaseous material, which can be homogeneous or heterogeneous, and can contain one or more solid or gaseous materials dissolved or suspended therein.

As used herein, the term "reaction mixture" refers to any solution in which a chemical, physical or biological change is effected. In general, a change to a molecule is effected, although changes to cells also are contemplated. A reaction mixture can contain a solvent, which provides, in part, appropriate conditions for the change to be effected, and a substrate, upon which the change is effected. A reaction mixture also can contain various reagents, including buffers, salts, and metal cofactors, and can contain reagents specific to a reaction, for example, enzymes, nucleoside triphosphates, amino acids, and the like. For convenience, reference is made herein generally to a "component" of a reaction, where the component can be a cell or molecule present in a reaction mixture, including, for example, a biopolymer or a product thereof.

As used herein, submicroliter volume, refers to a volume conveniently measured in nanoliters or smaller and encompasses, for example, about 500 nanoliters or less, or 50 nanoliters or less or 10 nanoliters or less, or can be measured in picoliters, for example, about 500 picoliters or less or about 50 picoliters or less. For convenience of discussion, the term "submicroliter" is used herein to refer to a reaction volume less than about one microliter, although it is apparent to those in the art that the systems and methods disclosed herein are applicable to subnanoliter reaction volumes as well. As used herein, nanoliter volumes generally refer to volumes between about 1 nanoliter up to less than about 100, generally about 50 or 10 nanoliters.

As used herein, high-throughput screening (HTS) refers to processes that test a large number of samples, such as samples of diverse chemical structures against disease targets to identify "hits" (see, e.g., Broach et al. "High throughput screening for drug discovery," Nature, 384(6604 Suppl) :14–16 (1996); Janzen, et al. "High throughput screening as a discovery tool in the pharmaceutical industry," Lab Robotics Automation 8:261–265 (1996); Fernandes, P. B., "Letter from the society president," J. Biomol. Screening, 2(1):1–9 (1997); Burbaum, et al., "New technologies for high-throughput screening," Curr. Opin. Chem. Biol., 1(1):72–78 (1997)). HTS operations are highly automated and computerized to handle sample preparation, assay procedures and the subsequent processing of large volumes of data.

A. Substrates/Supports

Any substrate suitable for biological and chemical reactions and assays, such as diagnostic and hybridization assays in which samples are deposited at discrete loci is contemplated for use herein. In some embodiments the hydrophilic regions occupy less surface area than the hydrophobic regions. The percentage of surface area that is hydrophobic or hydrophilic can vary so long as the majority (greater than about 50%) of surface area is hydrophobic. Exemplary percentages of hydrophobic regions can be in the range of at least 51%, 55%, 60%, 65%, 70%, 75%, 80%, 85%, 90%, 91, 92, 93, 94, 95%, 96, 97, 98, 99 and 99.9%.

In particular, substrates having arrays or microarrays in which a substantially hydrophilic region (e.g., a target or contact region) is surrounded by a more substantially hydrophobic region or area and methods for preparation of such substrates are provided herein. The substrate surface can be any surface that has an available reactive group, such as —OH or a primary amine, or is derivatized to have such a group that can be ionized to form a hydrophilic surface. Exemplary surfaces include, but are not limited to glass, derivatized glass, plastics, silicon, silicon dioxide ($SiO_2$) and any other such materials known to those of skill in the art.

Also provided herein are methods of producing substrates and the resulting substrates that have contact angles that result in hydrophobic focusing of hydrophilic liquids onto the hydrophilic loci formed by generating a contact angle differential gradient (against water) greater than 55 degrees between the hydrophilic and hydrophobic surfaces. As a result, the substrates include hydrophilic regions (i.e., discrete loci) on a surface that are substantially less hydrophobic than the surrounding surface. Hydrophobicity is measured by the relative wettability (relative contact angle) of the surrounding area compared to each hydrophilic region (locus). For example, the contact angle of each hydrophilic region is at least 55 degrees less than that of the surrounding hydrophobic surface, and can be, for example, at least 60, at least 65, at least 75, at least 80, at least 85, at least 90 degrees or more, less than that of the surrounding hydrophobic surface.

To produce such arrays, a surface, such as any of those described herein or known to those of skill in the art to be suitable for linking or retaining macromolecules, including biopolymers, such as silicon or $SiO_2$ is used. For example, a silicon substrate (e.g., a chip) can be first treated with a corona discharge to obtain a clean pure $SiO_2$ surface. The substrate can then be coated (e.g., such as by gas phase) with Dimethyldichlorosilane (DMDCS, 5% in heptane) to create a hydrophobic surface with a contact angle about 55 up to at lease 90 degrees against water. To introduce round hydrophilic anchors onto the surface of the chip, the chip can be covered with a mask (e.g., a ceramic mask) and corona treated again to selectively remove the hydrophobic surface at the designated round regions. The resulting hydrophilic $SiO_2$ domains produced by the methods herein have a contact angle of ca. less than or equal to about 14 degrees against water, leading to a contact angle differential gradient of at least 45 degrees up to at least 80 degrees or more between the $SiO_2$-silane hydrophilic-hydrophobic regions. Example 1 exemplifies this process and the resulting substrates with patterned microarrays. The substrates are typically about 30.0 mm×20.0 mm, such as 30.68 mm×19.68 mm, or can be smaller or larger. The number of hydrophilic regions (e.g., target loci) on each substrate can be any desired number, such as, 8, 16, 24, 96, 384, 1536, 2500, 3000, 3500, 4000, 4096, 4500, 5000, 10,000, 15,000 or more. As set forth herein, other combinations of surface materials in which the contact angle between the hydrophilic and hydrophobic surfaces is greater than or equal to 55 degrees are contemplated.

Likewise, the total number of hydrophilic target detection locations (loci) on a substrate or support can be as many discrete hydrophilic target detection loci as desired, so long as it is ensured that a sufficient sample size is present to achieve the desired chemical reaction. In certain embodiments, the surface of a substrate can contain up to 5,000 or more discrete hydrophilic loci on a substrate. For example, 1, 2, 3, 4, 5, 6, 7, 8, 10, 15, 20, 25, 30, 40, 50, 60, 70, 80, 90, 96, 100, 200, 300, 384, 400, 500, 600, 700, 800, 900, 1000, 1500, 1536, 2000, 3000, 4000, 4096 up to 5000 or more discrete hydrophilic regions can be confined on a single substrate. In certain embodiments, the substrates typically have 96-, 384-, 1536-, 4096-hydrophilic loci. As set forth herein, higher densities of hydrophilic loci and densities that are multiples of other than 96 also are contemplated. In particular embodiments, the hydrophilic regions are equidistant to each other sample in the same grid, row and/or column (or both row and column), which permits precise identification and analysis of the target samples in automated high-throughput format.

In some embodiments, the substrates provided herein are particularly useful with the apparatus and methods described in U.S. patent application Ser. No. 10/412,801, filed on Apr. 11, 2003 entitled METHOD AND DEVICE FOR PERFORMING CHEMICAL REACTION ON A SOLID SUPPORT (incorporated herein by reference in its entirety), where the gaskets having the reaction chambers therein are produced to encompass/overlay the hydrophilic target regions of the substrates provided herein.

B. Hydrophilic Layers

The hydrophilic regions can be created by destruction of a hydrophobic layer that has been overlayed over the hydrophilic layer. In certain embodiments, corona discharge treatment is used to physically remove particular regions of a hydrophobic surface layer that are exposed to the treatment through a mask. For example, in certain embodiments where the surface is silicon; any surface that has an available reactive group (such as a —OH or a primary amine) can be used as the hydrophilic surface, including but not limited to glass, derivatized glass, plastics and other such materials can be used.

C. Hydrophobic Layers

In some embodiments, it is contemplated herein, for reasons of simple manufacture, to use sample support plates of metal or metallized plastic, and to make the surface hydrophobic. This can be done, for example, using a hydrophobic lacquer, or also by gluing on a thin, hydrophobic film, for example of Teflon. It is more practical to make the metal surface hydrophobic using a monomolecular chemical change, since a certain electrical conductivity, even if highly resistant, is then maintained.

Such hydrophobing of a metal surface is essentially known. For instance, longer alkane chains (for example, linear C18 chains) are usually covalently bonded by a sulfur bridge to the atoms of the metal surface. This bond is extremely solid, and cannot be washed off using normal means. Surfaces that are even more hydrophobic are achieved if the hydrogen atoms are replaced by fluorine atoms at the end of the alkane chains. There are many equivalent methods of hydrophobing, and it can be effected, for example, using silicones, alkylchlorosilanes or tin-organic compounds.

The production of a dense layer of such alkane chains on the metal surface is very simple in principle. In certain embodiments for accomplishing this, the corresponding alkane thioles (alkane hydrogen sulfides) are first dissolved in methanol. The metal plates are then immersed vertically in a water bath. If one drop of the methanolic solution of alkane thioles is added to the water, the alkane thioles move into an ordered formation on the surface of the water. All molecules are aligned in parallel in a very tight arrangement. The hydrophobic alkane ends are on the surface of the water bath, the hydrophilic thiole groups point into the water. If the metal plate is now pulled carefully out of the water, the closed formation of alkane thioles moves to the surface of the metal plate and creates covalent bonds of individual molecules with metal atoms of the surface while forming metal thiolates, at the same time maintaining the parallel orientation having a dense coating.

D. Masks

The methods provided herein use a mask, typically having an array of holes (of any shape) in a pattern, and which mask is interposed between an oxidizing force and the substrate surface on which a hydrophilic surface is to be generated or deposited. For example, the corona discharge treatment can be directed through a hole or an array of holes in a mask and onto a substrate surface. In the case of a mask having an array of holes, the methods disclosed herein provide the virtually simultaneous formation of as many distinct hydrophilic regions on the substrate-surface as the number of holes in a mask positioned over the substrate.

In some embodiments, to produce the hydrophilic regions on the substrate surface, a mask having a predetermined pattern and/or mesh size is placed over the hydrophobic surface region. It has been found the use of such masks produce a pattern of hydrophilic regions corresponding to the mask pattern on the substrate surface. Masked portions of the substrate surface are not exposed to the corona treatment, preserving the original properties of the hydrophobic surface under the masked areas. As set forth herein the particular pattern used for the masks can be varied by the skilled artisan to create the desired number, size and density of hydrophilic regions on the substrate surface. Exemplary masks suitable for use herein are well-known in the art and can be made from any insulating material, such as ceramic material and the like. Such masks are available, for example, from Accu Tech Laser Processing (San Marcos, Calif.).

E. Treatments

There are a variety of ways of treating the exposed major surface of the hydrophobic layer in the methods provided herein. The exposed major surface can be corona treated, oxygen plasma treated, chemically treated such as with a solution or chemical etchant, ozone treated, or laser treated. Regardless of the particular method chosen, the hydrophobic surface often is removed from the exposed major surface to increase exposure of the hydrophilic surface, e.g., metal oxide, etc., so that there is a sharp contrast in contact angles of the hydrophilic and hydrophobic surfaces. In particular embodiments, the contact angle differential between the hydrophobic and hydrophilic regions is greater than a differential selected from 55, 60, 65, 70, 75, 80, 85 or 90 degrees.

In a particular embodiment, when about 2 or 3 multiple atmospheric corona discharge treatments are used to remove the exposed hydrophobic regions from the exposed surface, the dose energy level generally is in the range of at least about 100 up to about 3000 W*min/m, and typically is in the range of about 370 up to about 1,600 W*min/m. When the exposed major surface is subject to a single atmospheric corona treatment, the energy level can typically be twice the amount that is used when the exposed major surface is multiply treated.

F. Sample Preparation

In certain embodiments, the sample droplets are applied to the sample support using pipettes. For simultaneous application of many sample droplets from microtiter plates, multiple pipettes are used, moved by pipette robots in pipette machines. It is therefore desirable in this embodiment to use sample support plates having the size of microtiter plates, and to adapt the array of hydrophilic anchors to the well array of microtiter plates. In certain embodiments, the sample support plates have the shape of microtiter plates, so that they can be processed by conventional pipette robots. In addition, because a substantially higher density of samples can be obtained on the sample support than is possible in the microtiter plates, the array on the sample support plate can be much finer than that which corresponds to the array of wells on the microtiter plate. For example, this can be achieved by dividing the array distances of the microtiter plates by integer numbers. Then the samples from several microtiter plates can be applied to one sample support. In certain embodiments, the basic array of the original microtiter plate contains 96 small wells, at distances of about 9 millimeters from each other, arranged in 8 rows by 12 columns. Additional embodiments can have, for example, 384 or 1,536 microwells in array patterns spaced apart by 4.5 or 2.25 millimeters, respectively.

In particular embodiments, about 5 picoliters up through 500 nanoliters of sample solution can be pipetted from each pipette tip of the multiple pipette onto the sample support by drop on demand dispensation, such as using a piezo dispenser. The droplets, in the form of spheres can, even with horizontal misadjustment of the pipette tips, reach their respectively assigned hydrophilic regions and attach themselves.

When drying, the moisture within the droplets evaporates resulting in biomolecular sample-matrix crystal structures attached to the respective hydrophilic target loci. It is here that the lower contact angles achieved within the hydrophilic target regions results in greater contact angle differentials between the hydrophobic and hydrophilic regions on the surface of the substrate. This in turn results in a more uniform, even distribution, in the z-direction, of the biomolecular sample-matrix crystal structure on the hydrophilic target loci. The increased uniformity of distribution in the z-direction of the sample-matrix crystal structure results in less variability in the flight time and distance traveled by the ionized particles within the same target loci to the particle detector during MALDI-mass spectrometry analysis. These characteristics of a lower contact angle result in a sample crystalline surface structure that is flatter and has less arch (e.g., less ion variation in the z-direction) than samples deposited on hydrophilic surfaces having higher contact angles.

Hydrophobic as well as hydrophilic surfaces can alter their wetting characteristics with lengthy storage in ambient air by coating of the surface with contaminants from the air. It is therefore desirable to store the well prepared sample support plates in a vacuum or under protective gas.

The following example is included for illustrative purposes only and does not limit the scope of the invention.

EXAMPLE

A. Chip Preparation and Treatment

A Silicon-Chip (without photoresist) was first treated with a corona discharge to obtain a clean pure $SiO_2$ surface. The Chip was then gas phase coated with 3 μl Dimethyldichlorosilane (DMDCS, 5% in heptane) for 1 minute to create a hydrophobic surface with a contact angle of ca. 90 degrees against water. To introduce 200 μm round hydrophilic anchors onto the surface of a chip, the chip was covered with a ceramic mask and corona treated again to selectively remove the hydrophobic surface at the designated 200 μm round regions. For the atmospheric corona discharge treatment used to remove the exposed hydrophobic regions from the exposed surface, the dose energy level was in the range of about 300 up to about 1,600 W*min/m. The formula defining the corona discharge dose used herein is as follows:

$$D=N*P/(v*L),$$

where N=number of runs; P=power (20–200 Watt); v=electrode velocity [m/min]; L=electrode lengths [meters (m)], (in this example, v and L are fixed within the instrument).

Good results were obtained using the following parameters: N=2–3, P=20–60 Watts, v=0.54 m/min., L=0.2 meters; which resulted in a corona dose in the range of about 370 up to about 1,600 [W*min/m]. The resulting hydrophilic $SiO_2$ domains had a contact angle of ca. 10 degrees against water, leading to a contact angle differential gradient of 80 degrees between the $SiO_2$-silane hydrophilic-hydrophobic regions.

B. Nucleic Acid Sample Preparation

To prepare the sample solution containing the nucleic acid sample being analyzed, 11 nl of a 86 mM 3HPA (3-Hydroxy picolinic acid) matrix and 2 nl of analyte (Allelic Frequency sample, AF 90/10; 6617.4 Da/6273.2 Da) were spotted with a piezo-driven Gesim Nanoplotter (e.g., available from Gesim GmbH, Germany) and gave a very homogeneous sample preparation with many spots of high analyte yields (hot spots). From this preparation, 58 spectra from 11 positions were taken (20 shots each). The mass accuracy of the 2nd allele at 6617.4 Da was assessed, and 55% of the spectra were obtained at a mass deviation of ≦0.5 Da; 91% of the spectra were obtained at a mass deviation of ≦1 Da; and only 9% of the spectra were obtained at a mass deviation of >1 Da; with a maximum deviation from the theoretical mass of 1.7 Da.

The same analyte was compared and measured at 15 nl from a standard SpectroChip®. At 15 nl of analyte, the whole standard matrix was redissolved, resulting in a shrunk matrix spot with relatively high crystals growing in the z-direction. From this preparation few hot spots occur. For example 77 spectra from 27 positions were taken. Regarding the same 2nd allele at 6617.4 Da, only 22% of the spectra were obtained at a mass deviation of ≦0.5 Da, 39% at ≦1 Da, 61%>1 Da, 32%>2 Da and 16%>3 Da with a maximum deviation of 5 Da from the theoretical mass.

The entirety of each patent, patent application, publication and document referenced herein is incorporated by reference. Citation of the above patents, patent applications, publications and documents is not an admission that any of the foregoing is pertinent prior art, nor does it constitute any admission as to the contents or date of these publications or documents. The present methods and supports provided herein should not be seen as limited to the particular embodiments described herein, but rather, it should be understood that they have wide applicability with respect to sample delivery processes and systems generally. All modifications, variations, or equivalent arrangements and implementations that are within the scope of the attached claims, for example, should therefore be considered within the scope of the invention. Modifications may be made to the foregoing without departing from the basic aspects of the invention. Although the invention has been described in substantial detail with reference to one or more specific embodiments, those of ordinary skill in the art will recognize that changes may be made to the embodiments specifically disclosed in this application, and these modifications and improvements are within the scope and spirit of the invention. Embodiments of the invention are set forth in the claims which follow.

What is claimed:

1. A support suitable for mass spectrometric analysis comprising:

a conductive substrate; and discrete hydrophobic and hydrophilic regions on the substrate surface, wherein the hydrophilic regions have a contact angle less than or equal to 14 degrees.

2. The support of claim 1, wherein the hydrophilic regions have a contact angle less than or equal to 13, 12, 11, 10, 9, 8, 7, 6, 5, 4, 3, 2 or 1 degrees.

3. The support of claim 1, wherein the contact angle differential between the hydrophobic and hydrophilic regions is greater than 55, 60, 65, 70, 75, 80, 85 or 90 degrees.

4. The support of claim 1, wherein the hydrophobic surface is substantially non-retroreflective.

5. The support of claim 1, wherein the hydrophilic regions have a surface energy of about 73 $mJ/m^2$.

6. The support of claim 1, wherein the hydrophilic regions occupy less surface area than the hydrophobic regions.

7. The support of claim 1, wherein the hydrophilic regions are uniformly spaced on the substrate.

8. The support of claim 1, wherein the hydrophilic regions are obtained by treatment with an oxidizing force.

9. The support of claim 8, wherein the oxidizing force is selected from corona discharge, plasma treatment and laser treatment.

10. The support of claim 9, wherein the oxidizing force is corona discharge.

11. The support of claim 1, wherein the hydrophobic surface is devoid of inorganic oxide particles.

12. The support of claim 1, wherein the conductive substrate comprises a surface material that has an available —OH or primary amine.

13. The support of claim 1, wherein the hydrophobic region is dimethyldichlorosilane (DMDCS); and the substrate is selected from the group consisting of a metal, a plastic and a silicon or silicon dioxide, which forms the hydrophilic regions.

14. The support of claim 1, wherein the percentage of the total spectra obtained, when the substrate is used for mass spectrometric analysis, that are at a mass deviation of ≦0.5 Da is a percentage of the total spectra obtained selected from ≧25%, ≧30%, ≧40%, ≧50%, ≧55%, ≧60%, ≧65%, ≧70%, ≧75% of the total spectra obtained.

15. The support of claim 1, wherein the percentage of the total spectra obtained, when the substrate is used for mass spectrometric analysis, that are at a mass deviation of ≦1.0 Da is a percentage of the total spectra obtained selected from ≧40%, ≧50%, ≧55%, ≧60%, ≧65%, ≧70%, ≧75%, ≧80%, ≧85%, ≧90%, ≧91%, ≧92%, ≧93%, ≧94%, ≧95%, ≧96%, ≧97%, ≧98%, ≧99%, ≧99.9% of the total spectra obtained.

16. The support of claim 1, which further comprises a sample component.

17. The support of claim 16, wherein the sample component is a nucleic acid and/or a protein.

18. The support of claim 1, which further comprises a matrix material.

19. A method for mass spectrometric analysis comprising:

applying matrix material and sample to the hydrophilic regions on the support of claim 1;

introducing the substrate into a mass spectrometer for analysis of the samples; and analyzing the samples by mass spectrometry.

20. A method of making a support suitable for mass spectrometric analysis, comprising:

masking a subset of regions on the surface of a support comprising a hydrophobic surface; and applying an oxidizing force to the unmasked regions of the hydrophobic surface to render the unmasked regions hydrophilic under conditions that result in the hydrophilic regions having a contact angle less than or equal to 14 degrees against water.

* * * * *